US005184490A

United States Patent [19]

Takahashi

[11] Patent Number: 5,184,490

[45] Date of Patent: Feb. 9, 1993

[54] KEY SWITCH ASSEMBLY

[75] Inventor: Hiroyuki Takahashi, Tokyo, Japan

[73] Assignee: Takigen Manufacturing Co., Ltd., Tokyo, Japan

[21] Appl. No.: 905,803

[22] Filed: Jun. 29, 1992

[30] Foreign Application Priority Data

Feb. 13, 1992 [JP] Japan ..... 4-013897[U]

[51] Int. Cl.[5] ..... H01H 27/08

[52] U.S. Cl. ..... 70/277; 70/389; 70/453; 70/DIG. 30; 200/43.06

[58] Field of Search ..... 70/277, 278, 283, 389, 70/390, 453, DIG. 30; 200/42.02, 43.06, 43.08, 61.59

[56] References Cited

U.S. PATENT DOCUMENTS

| | | | |
|---|---|---|---|
| 1,622,732 | 3/1927 | Nelson | 70/DIG. 30 X |
| 3,702,550 | 11/1972 | Shimizu | 70/389 X |
| 3,798,398 | 3/1974 | Hills | 70/283 X |
| 3,912,888 | 10/1975 | Takahashi | 200/43.06 |
| 4,198,552 | 4/1980 | Tahara | 200/43.06 |
| 5,092,148 | 3/1992 | Rong-Long | 70/278 |

*Primary Examiner*—Lloyd A. Gall
*Attorney, Agent, or Firm*—Martin Smolowitz

[57] ABSTRACT

A key switch assembly, which can reliably eliminate swinging of the key end and erroneous operation due to incomplete insertion of a key. A guide extends rearward of a lock cylinder received in a lock body and parallel to a switch juxtaposition. One side of the guide is aligned to an extension of a key groove surface and is provided with an axial positioning ridge for engagement with an axial positioning groove formed in a side of the key. A restricting front face of a guide disk secured to the lock body is held in contact with the rear face of the lock cylinder. The guide disk is provided with a restricting notch, the radius of curvature of an arcuate edge of which is made smaller than the radius of rotation of the key. The key has an edge provided with an escapement groove, into which the arcuate edge escapes when the key inserted to a predetermined depth is turned, and the guide has its stem provided with an escapement groove, which is engaged by the arcuate edge.

3 Claims, 9 Drawing Sheets

FIG. 1
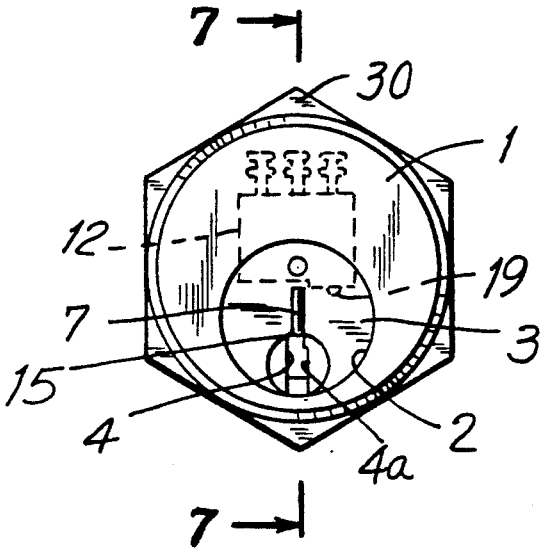
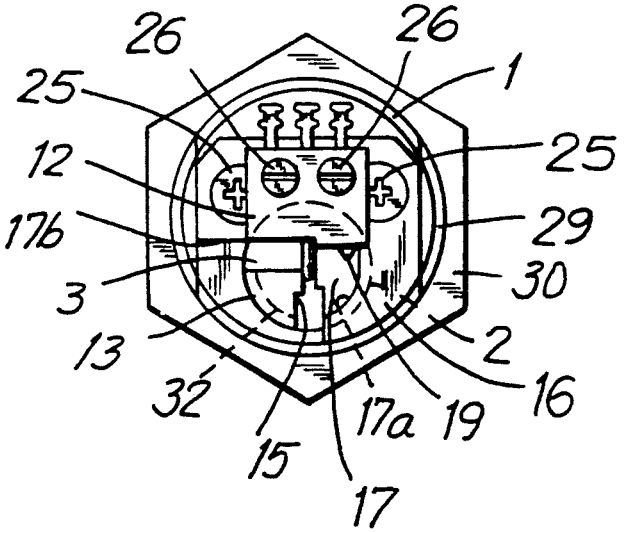
FIG. 2

FIG. 3
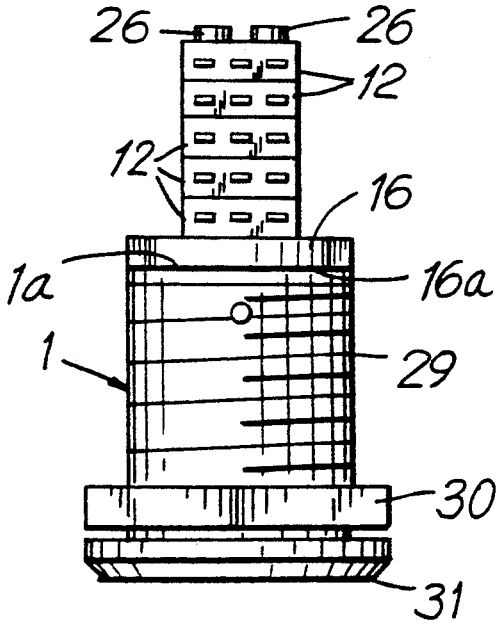
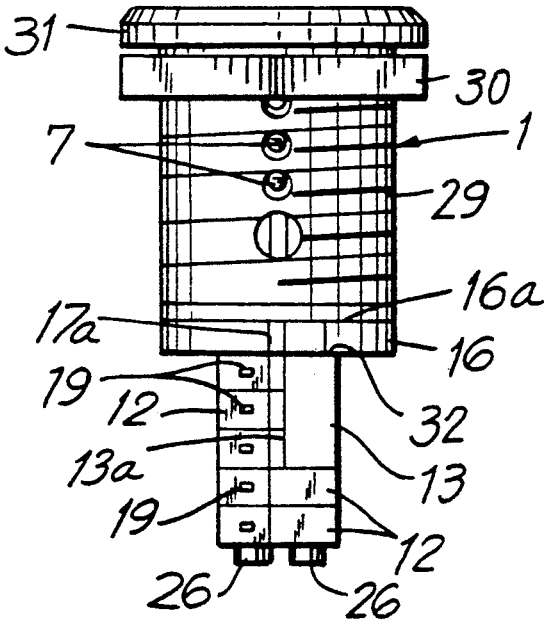
FIG. 4

FIG. 5
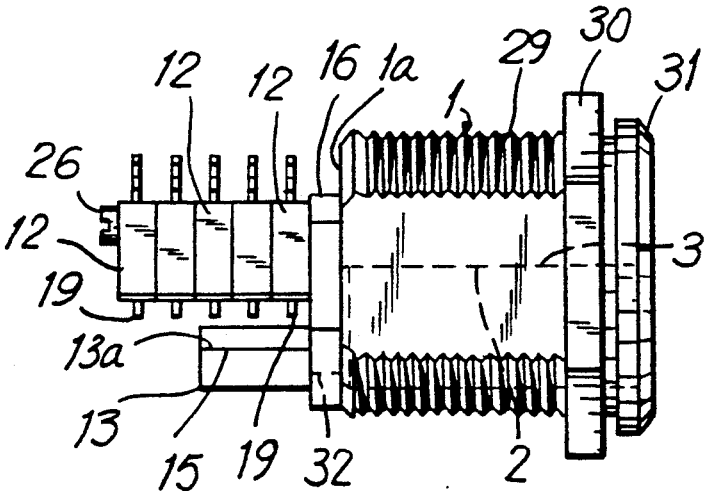
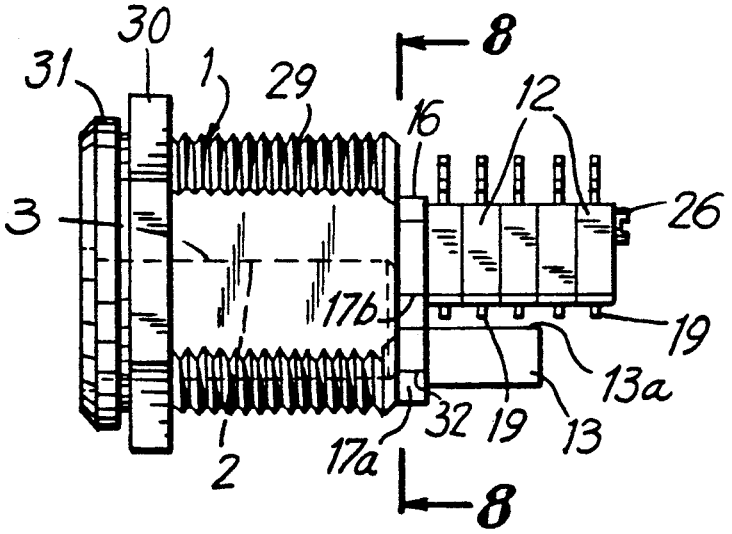
FIG. 6

FIG. 9
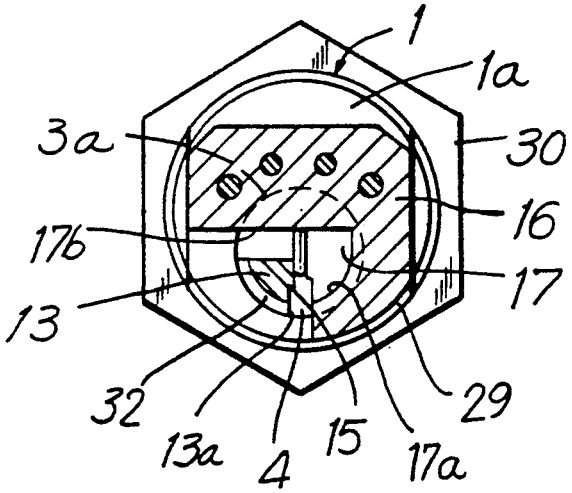
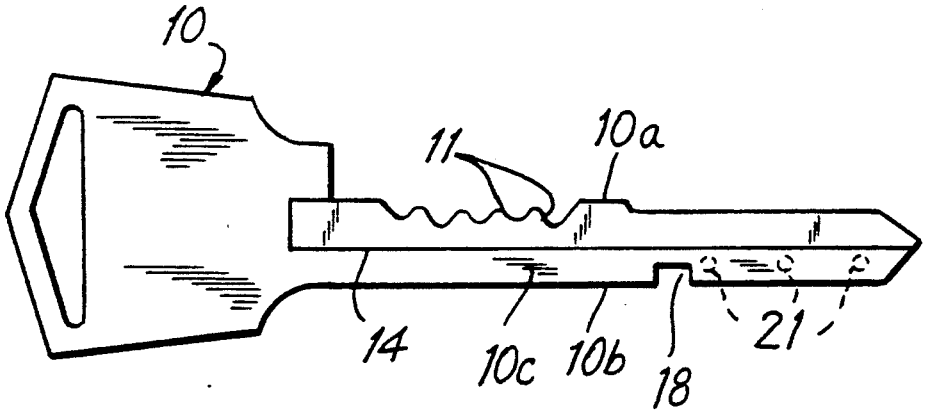
FIG. 10

FIG. 17
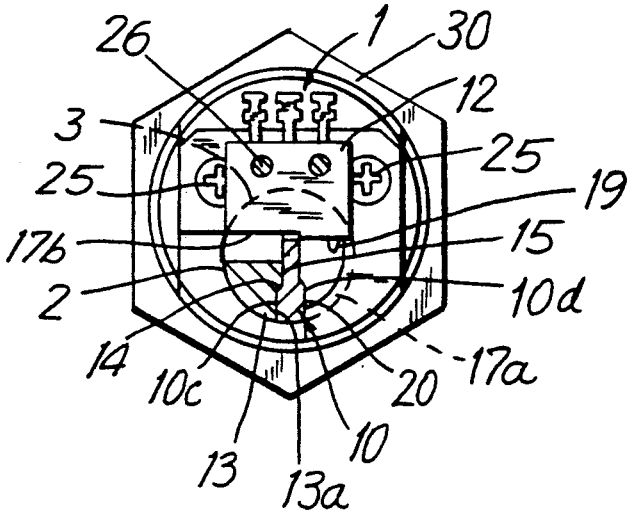
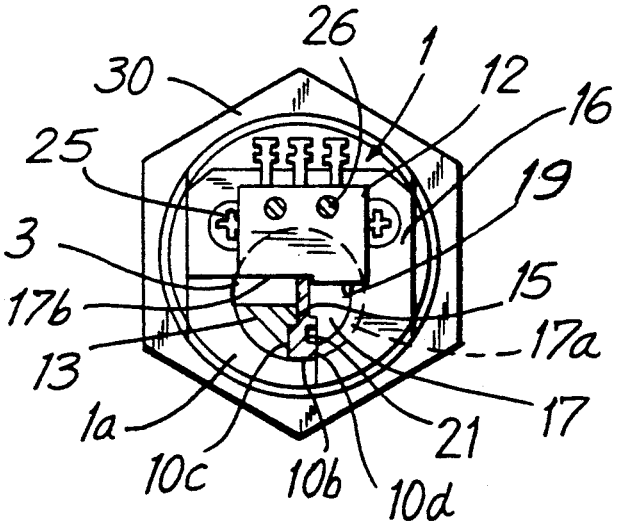
FIG. 18

FIG. 19
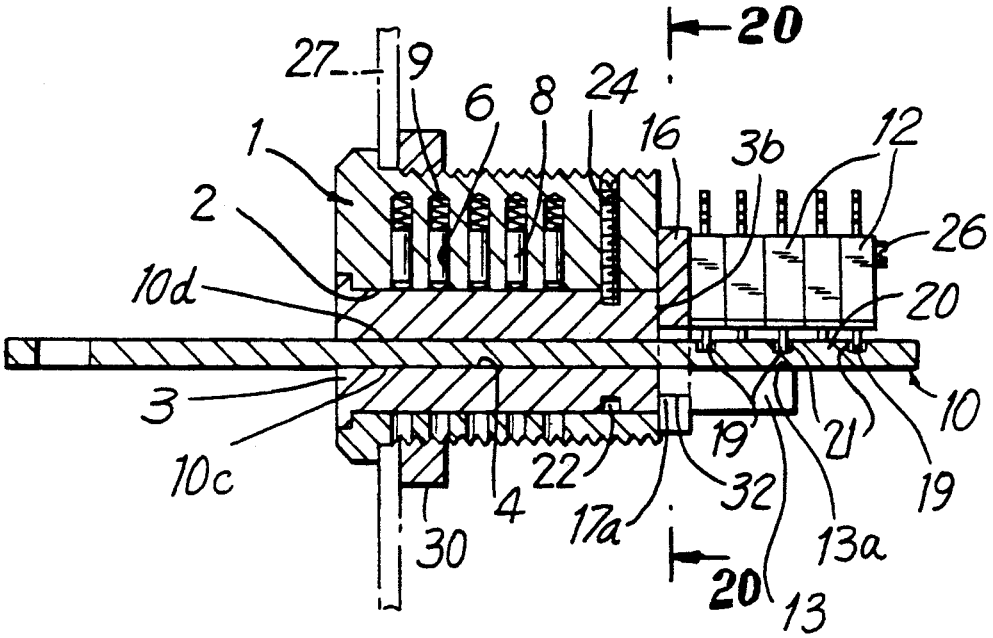
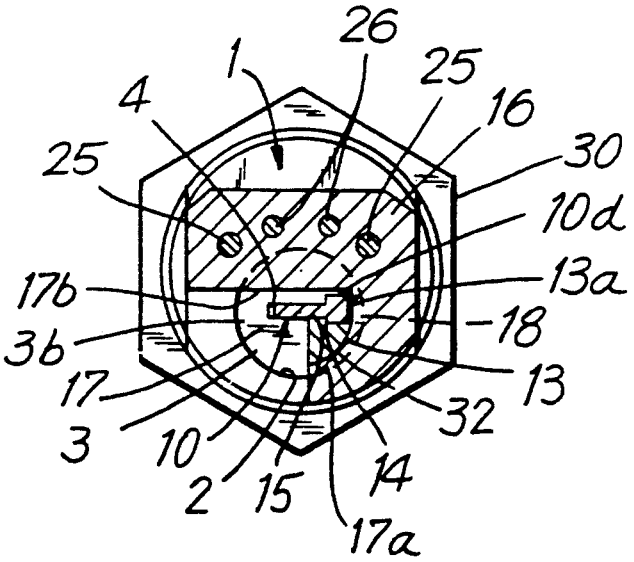
FIG. 20

KEY SWITCH ASSEMBLY

BACKGROUND OF THE INVENTION

1. Field of the Invention

This invention relates to a key switch assembly and, more particularly, a key switch assembly which can reliably eliminate swinging of a key end and erroneous operation due to incomplete insertion of a key.

2. Prior Art

Japanese Utility Model Publication No. 23650/1979 shows a key switch assembly, which comprises a lock body, a lock cylinder received in a lock cylinder reception bore of the lock body and having an axial key groove and a plurality of radial pin reception bores, the lock body having radial pin reception bores communicating with the pin reception bores of the lock cylinder, driven and drive pins received in the pin reception bores and biased by compression coil springs toward the key groove, a key having one edge formed with operation sections for displacing the point of contact between each driven pin and each drive pin to a position corresponding to the outer periphery of the lock cylinder, and a plurality of switches secured as an axial juxtaposition to the back of the lock body, an end portion of the key rearwardly projecting from the lock cylinder having one side provided with operation sections for depessing actuator pins of the switches and non-operation sections, through which the actuator pins can pass.

In this key switch assembly, when the key is inserted into the key groove to a predetermined depth such that its operation and non-operation sections face associated actuator pins, the point of contact between each driven pin and each drive pin is brought to a position corresponding to the outer periphery of the lock cylinder. Thus, the lock cylinder is unlocked relative to the lock body and ready to be rotated. By rotating the lock cylinder in this state with the key, the operation sections in an end portion of the key turn on or off specific switches, while the non-operation sections hold other specific switches "on" or "off". Thus, specific one of apparatuses, to which the switches are connected, are made operative, while other apparatuses are held inoperative.

With the key switch assembly having the above construction, a swing of the key end from the normal position may result in insufficient depression or failure of depression of an actuator pin of a switch, which is disposed in a deviated position. In such a case, an erroneous operation signal is possibly supplied to the associated apparatus. A major cause of occurrence of the key swing resides in the play present between the surface of the lock cylinder reception bore and the outer periphery of the lock cylinder. Therefore, it is desired to reduce the play so as to align the axis of the lock cylinder and the axis of the lock cylinder reception bore as much as possible.

However, certain allowances are provided in the manufacture of the lock body and lock cylinder, and also for smooth rotation of the lock cylinder a minimum play is necessary and indispensable. Therefore, limitations are imposed on the play reduction from the standpoints of the manufacture and functions. Further, wear produced in long use is another cause of increasing the play.

In another respect, with the prior art key switch assembly the lock cylinder is liable to be occasionally unlocked before the key is perfectly inserted to a predetermined extent. If the key is turned in this half inserted state, switches in a zone not reached by the key are not turned on or off at all, and also switches in a zone reached by the key are not turned on or off in a normal fashion, thus possibly providing erroneous operation signals to apparatuses.

In the lock structure used for this key switch assembly, a number of different key codes, i.e., key differences, are obtained by increasing or reducing the depth of each of operation section of the key and the length of each driven pin with a predetermined dimension as a unit. Actually, however, wear produced in long use is added to the allowance provided for manufacture, and it is liable that the play between the lock cylinder reception bore and lock cylinder exceeds the minimum unit of the key code setting.

To avoid the half insertion lock, the minimum unit of key code setting may be made as large as possible. When the minimum unit is increased, however, the outer diameter of the lock body and lock cylinder has to be increased to ensure a large number of key codes. This is undesired in the light of the demand for reducing the size and weight of the assembly.

SUMMARY OF THE INVENTION

An object of the invention is to provide a key switch assembly, which can reliably eliminate the swing of the key end and erroneous operation due to half insertion lock.

To attain the above object of the invention, there is provided a key switch assembly, which comprises a lock body having a lock cylinder reception bore, a lock cylinder received in the lock cylinder reception bore and having an axial key groove and a plurality of first radial pin reception bores, the lock body having a second radial pin reception bores each in communication with each of the first radial pin reception bores, driven and drive pins received in the first and second radial pin reception bores, compression coil springs biasing the driven and drive pins toward the key groove, a key having one edge formed with a pin operation section for displacing the point of contact between each driven pin and each drive pin to a position corresponding to the outer periphery of the lock cylinder, a plurality of switches secured as an axial juxtaposition to the rear face of the lock body, a guide projecting rearward of the lock body and parallel to the switch juxtaposition, the guide having one side in frictional contact with a side of the key aligned to an extension of a surface of the key groove, the side of the guide having an axial positioning ridge engaged in an axial positioning groove formed in the side of the key, a guide disk secured to the rear face of the lock body, the guide disk having a restricting front face in contact with the rear face of the lock cylinder, the guide disk having a restricting notch with an arcuate edge having a radius of curvature smaller than the radius or rotation of the key, the key having the other edge formed with an escapement groove engaged by the arcuate edge of the guide disk when the key inserted to a predetermined depth is turned, the guide having a stem portion with the outer periphery thereof formed with a second escapement groove engaged by the arcuate edge, the key having the other side formed in an end portion thereof with operation sections for depressing actuator pins of the switches and non-operation sections for escapement therein of the actuator pins.

With the key switch assembly according to the invention, the guide extending rearward of the lock cylinder is held parallel to the juxtaposition of the switches, the key has one side held in contact with the side of the guide aligned to the extension of a surface of the key groove, and the axial positioning groove of the key is engaged with the axial positioning ridge of the guide. Thus, it is possible to reliably prevent swing of the key end.

In addition, the guide disk is provided with the restricting notch, with the radius of curvature of the arcuate edge of the restricting notch set to be smaller than the radius of rotation of the key, and the other edge of the key is formed with the escapement groove, which is engaged by the arcuate edge of the guide disk when the key is inserted to a predetermined depth and is turned. If the insertion of the key is imperfect, the start face of the arcuate edge of the guide disk engages with the key, thus reliably preventing key operation in a half inserted state.

BRIEF DESCRIPTION OF THE DRAWINGS

FIG. 1 is a front view showing an embodiment of the key switch assembly according to the invention with a key removed;

FIG. 2 is a back view showing the key switch assembly with the key removed;

FIG. 3 is plan view showing the key switch assembly with the key removed;

FIG. 4 is a botton view showing the key switch assembly with the key removed;

FIG. 5 is a left side view showing the key switch assembly with the key removed;

FIG. 6 is a right side view showing the key switch assembly with the key removed;

FIG. 9 is a sectional view taken along line 9—9 in FIG. 7;

FIG. 10 is a right side view showing the key used with the key switch assembly;

FIG. 17 is a sectional view taken along line 17—17 in FIG. 15;

FIG. 18 is a sectional view taken along line 18—18 in FIG. 15;

FIG. 19 is a sectional view corresponding to FIG. 7 but showing the key switch assembly with the key inserted and turned; and FIG. 20 is a sectional view taken along line 20—20 in FIG. 19.

DETAILED DESCRIPTION OF THE INVENTION

Figure 7:
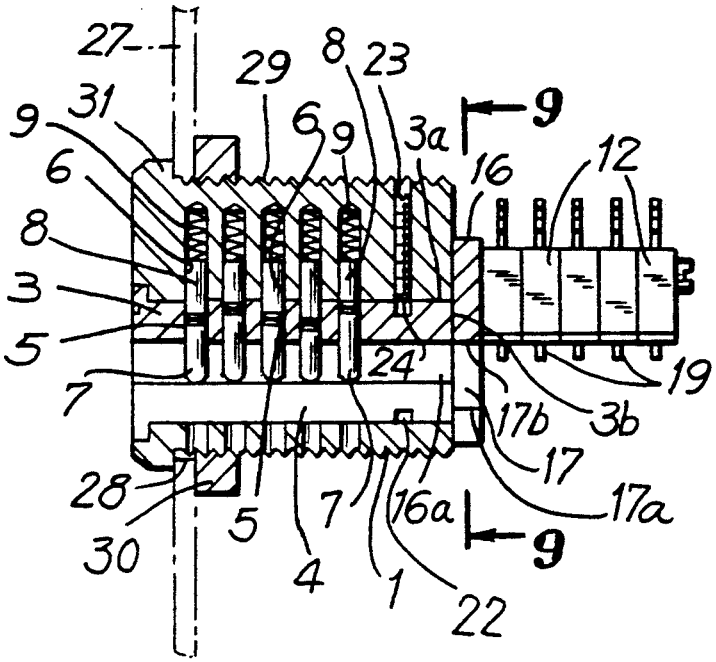
FIG. 7 is a sectional view taken along line 7—7 in FIG. 1.

The illustrated key switch assembly according to the invention comprises a lock body 1 having a lock cylinder reception bore 2 in which a lock cylinder 3 is received. The lock cylinder 3 has an axial key groove 4 and a plurality of radial pin reception bores 5. The lock body 1 has radial pin reception bores 6 each in communication with each of the radial pin reception bores 5. Driven and drive pins 7 and 8 are received in the radial pin reception bores 5 and 6 and biased by compression coil springs 9 toward the key groove 4. A key 10 has one edge 10*a* formed with a pin operation section 11, which can effect displacement of the point of contact between each driven pin 7 and drive pin 8 to a position corresponding to the outer periphery 3*a* of the lock cylinder 3. A plurality of switches 12 are secured as an axial juxtaposition to the back of the lock body 1.

A guide 13 projects rearward of the lock body 1 and parallel to the juxtaposition of the switches 12. The guide 13 has its side 13*a* in frictional contact with a side 10*c* of the key 10 aligned to an extension of the key groove 4. The side 13*a* of the guide 13 has an axial positioning ridge 15, which is engaged in an axial positioning groove 14 formed in the side 10*c* of the key 10. A guide disk 16 is secured to the rear face 1*a* of the lock body 1. The guide disk 16 has a restricting front face 16*a* in contact with the rear face 3*b* of the lock cylinder 3.

The guide disk 16 has a restricting notch 17 with an arcuate edge 17*a* having a radius of curvature smaller than the radius of rotation of the key 10. The key 10 has the other edge 10*b* formed with an escapement groove 18 engaged by the arcuate edge 17*a* of the notch 17 when the key 10 is inserted in the assembly to a predetermined depth thereof and is turned. The guide 13 has a stem portion with the outer periphery thereof formed with an escapement groove 32 which is engaged by the arcuate edge 17*a*. The other side 10*c* of the key 10 has an end portion formed with operation sections 20 for depressing actuator pins 19 of the switches 12 and non-operation sections, into which the actuator pins 19 can escape.

In a state with the key 10 removed from the key groove 4 of the lock cylinder 3, as shown in FIG. 7, the drive pins 8 biased by the compression coil springs 9 are partly received in the pin reception bores 5 of the lock cylinder 3, and the point of contact between each driven pin 7 and each drive pin 8 is found on the inner side of the outer periphery of the lock cylinder 3. Thus, the lock cylinder 3 is held locked to the lock body 1 and can not be turned with respect thereto.

Figure 15:
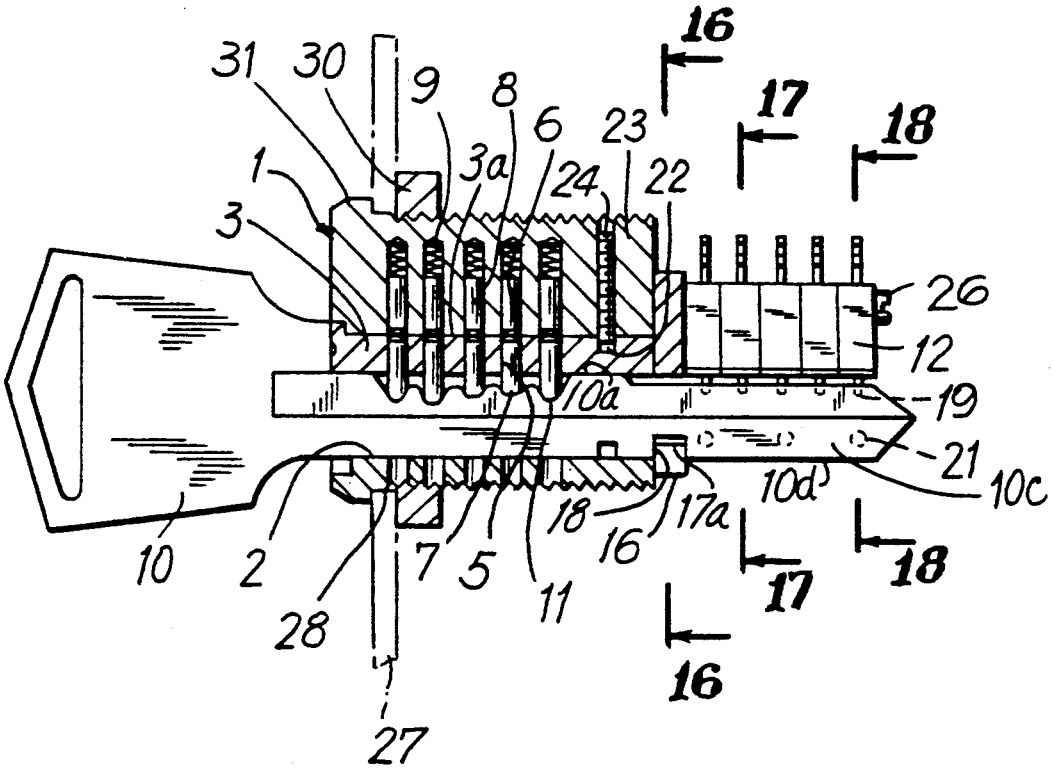
FIG. 15 is a sectional view corresponding to FIG. 7 but showing the key switch assembly with the key inserted.

When the key 10 is inserted to a predetermined depth into the key groove 4 of the lock cylinder 3, as shown in FIG. 15, its end projected for a predetermined length from the rear face 1*a* of the lock body 1. Before the end of the key 10 projects from the rear face 1*a* of the lock body 1, the side 10*c* of the key 10 is in frictional contact with the surface 4*a* of the key groove 4. After the key 10 projects from the rear face 1*a* of the lock body 1, its side 10*c* is in frictional contact with the side 13*a* of the guide 13, and its positioning groove 14 is in engagement with the positioning ridge 15 of the guide 13, as shown in FIG. 16.

Figure 16:
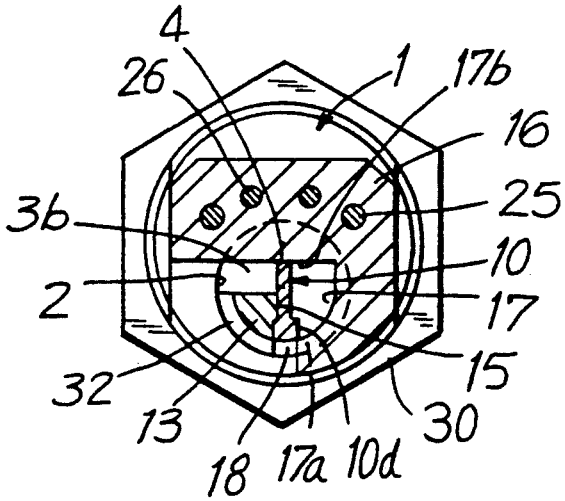
FIG. 16 is a sectional view taken along line 16—16 in FIG. 15.

When the key 10 is prefectly inserted for a required length, the operation and non-operation sections 20 and 21 are found at positions corresponding to the associated actuator pins 19 of the switches 12, as shown in FIGS. 17 and 18, and the escapement groove 18 of the key is found at a position corresponding to the arcuate edge 17*a* of the restricting notch 17 of the guide disk 16, as shown in FIG. 16. In this perfectly inserted state, the operation sections 11 of the key 10 are holding the driven pins 7 displaced outward by a predetermined distance, and the point of contact between each driven pin 7 and each drive pin 8 is flush with the outer periphery 3*a* of the lock cylinder 3. That is, the lock cylinder 3 is in an unlocked state with respect to the lock body 1.

By turning the key 10 in this state, as shown in FIGS. 19 and 20, the arcuate edge 17*a* of the guide disk 16 enters the escapement groove 18 of the key 10 and the escapement groove 32 of the guide 13. In this way, the lock cylinder 3 and key 10 are rotated with respect to the lock body 1. At the final point of rotation of the key 10 toward the switches 12, the operation sections 20 pushes actuator pins 19 of specific switches 12 to a predetermined depth, thus turning on or off the switches 12 to provide predetermined operation signals to associated apparatuses. In switches 12, of which ends of actuator pins 19 have escaped into non-operation sections 21, the initial "on" or "off" state is maintained.

Figure 8:
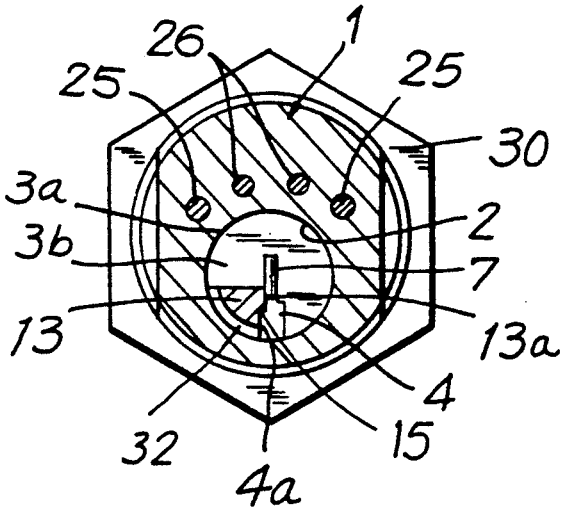
FIG. 8 is a sectional view taken along line 8—8 in FIG. 6.
Figure 11:
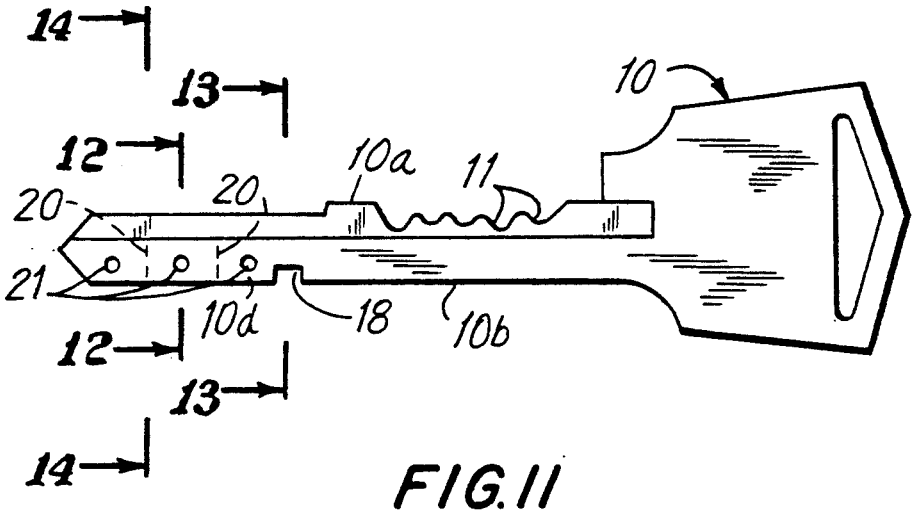
FIG. 11 is a left side view showing the key.
Figure 12:
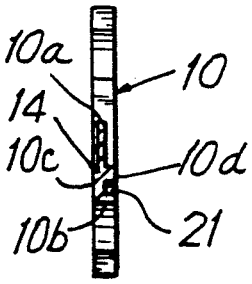
FIG. 12 is a sectional view taken along line 12—12 in FIG. 11.
Figure 13:
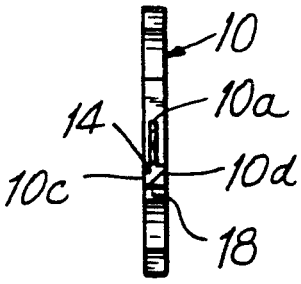
FIG. 13 is a sectional view taken along line 13—13 in FIG. 11.
Figure 14:
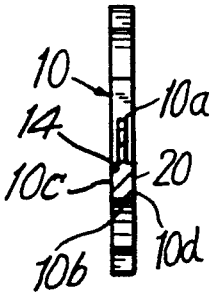
FIG. 14 is a sectional view taken along line 14—14 in FIG. 11.

In the illustrated embodiment, the outer periphery 3*a* of the lock cylinder 3 has a rear end portion formed with an annular groove 22, in which is engaged an end portion of a lock pin 24 driven and secured in a radial pin bore 23 formed in the lock body, as shown in FIG. 7, thus preventing axial displacement of the lock cylinder 3. As shown in FIGS. 2 and 8, the guide disk 16 is secured by two screws 25 to the rear face 1*a* of the lock body 1, and the switches 12 are secured by two screws 26 to the guide disk 16 and lock body 1.

As shown in FIG. 9, in the restricting notch 17 of the guide disk 16, a straight edge 17*b* extends from the arcuate edge 17*a* and, as shown in FIG. 20, the side 10*d* of the key 10 strikes the straight edge 17*b*, thus limiting the rotational angle of the lock cylinder 3 to 90 degrees. As shown in FIG. 7, the lock body 1 is inserted through a hole 28 of a mounting panel 27 and clampedly secured to the mounting panel 27 by a nut 30 screwed on its outer peripheral thread 29 and its front end flange 31. The pin reception bores in the lock body 1 are formed across the key groove 4 and open at one end on the outer peripheral thread 29 to facilitate the machining.

As has been shown in the foregoing, with the key switch assembly according to the invention the guide disk 16 is secured to the rear face 1*a* of the lock body 1, and the rear face 3*b* of the lock cylinder 3 is held in contact with the restricting front face 16*a* of the guide disk 16, thus preventing deviation of the axis of the lock cylinder 3 from the axis of the lock cylinder reception bore 2. In addition, the guide 13 extending rearward of the lock cylinder 3 is held parallel to the juxtaposition of the switches 12, the side 10*c* of the key 10 is held in contact with the side 13*a* of the guide 13 aligned to the extension of the surface 4*a* of the key groove 4, and the axial positioning groove 14 of the key 10 is engaged with the axial positioning ridge 15 of the guide 13. Thus, it is possible to reliably prevent swing of the end of the key 10. It is thus possible to permit a predetermined signal to be supplied to an associated apparatus with the actuator pin 19 of the associated switch 12 pushed to a predetermined depth by the associated operation section 20 of the key 10.

Further, with the key switch assembly according to the invention the guide disk 16 is provided with the restricting notch 17, with the radius of curvature of the arcuate edge 17*a* of the restricting notch set to be smaller than the radius of rotation of the key 10, and the other edge 10*b* of the key 10 is formed with the escapement groove 18, which is engaged by the arcuate edge 17*a* when the key 10 inserted to a predetermined depth is turned. If the insertion of the key 10 is imperfect, the start face of the arcuate edge 17*a* of the guide disk 16 engages with the side 10*d* of the key 10, thus reliably preventing the operation of turning the key 10 in a half inserted state. Therefore, even if the play between the lock cylinder reception bore 2 and lock cylinder 3 is increased, there is no possibility of occurrence of any erroneous operation of any switch 12.

I claim:

1. A key switch assembly comprising a lock body having a lock cylinder reception bore, a lock cylinder received in said lock cylinder reception bore and having an axial key groove and a plurality of first radial pin reception bores, said lock body having second radial pin reception bores each in communication with each of said first radial pin reception bores, driven and drive pins received in said first and second radial pin reception bores, compression coil springs biasing said driven and drive pins toward said key groove, a key having one edge formed with a pin operation section for displacing the point of contact between each driven pin and each drive pin to a position corresponding to the outer periphery of said lock cylinder, a plurality of switches secured as an axial juxtaposition to a rear face of said lock body, a guide projecting rearward of said lock cylinder and parallel to said switch juxtaposition, said guide having one side in frictional contact with a side of said key aligned to form an extension of a surface of said key groove, said side of said guide having an axial positioning ridge engaged in an axial positioning groove formed in said side of said key, a guide disk secured to a rear face of said lock body, said guide disk having a restricting front face in contact with said rear face of said lock body, said guide disk having a restricting notch with an arcuate edge having a radius of curvature smaller than the radius of rotation of said key, said key having another edge formed with an escapement groove engaged by said arcuate edge of said guide disk when said key inserted to a predetermined depth is turned, said guide having a stem portion with the outer periphery thereof formed with a second escapement groove engaged by said arcuate edge, said key having another side formed in an end portion thereof with operation sections for depressing actuator pins of said switches and non-operation sections for escapement therein of said actuator pins.

2. A key switch assembly according to claim 1, wherein said guide disk is secured to the rear face of said lock body and to the rear face of said lock cylinder by screw means, and the switches are secured to the rear face of the lock body by screw means.

3. A key switch assembly according to claim 1, wherein said lock body has outer peripheral threads and a nut for attaching the lock body into a hole in a panel wall.

* * * * *